United States Patent [19]

Mitter

[11] 4,440,808

[45] Apr. 3, 1984

[54] METHOD OF UNIFORMLY APPLYING LIQUID TREATING MEDIA TO FORAMINOUS WORKPIECES

[76] Inventor: Mathias Mitter, Schloss Holte, Fed. Rep. of Germany

[21] Appl. No.: 325,059

[22] Filed: Nov. 25, 1981

[30] Foreign Application Priority Data

Nov. 26, 1980 [DE] Fed. Rep. of Germany ..... 3044408

[51] Int. Cl.[3] ..... B05D 3/12

[52] U.S. Cl. ..... 427/244; 427/294; 427/358; 427/359; 427/369; 427/373

[58] Field of Search ..... 427/244, 373, 294, 296, 427/358, 359, 369; 8/149.1, 477; 118/415

[56] References Cited

U.S. PATENT DOCUMENTS 3,360,415 12/1967 Hellman et al. ..... 427/296 X 4,288,475 9/1981 Meeker ..... 427/294

FOREIGN PATENT DOCUMENTS 760935 6/1967 Canada ..... 427/358

*Primary Examiner*—Evan K. Lawrence

*Attorney, Agent, or Firm*—Kontler, Grimes & Battersby

[57] ABSTRACT

Liquid treating medium is uniformly applied to a textile workpiece by foaming it, depositing the foam in a confined space atop the workpiece, applying suction to the workpiece from below and thereafter mechanically pressing additional foam into the surface layer of the workpiece.

10 Claims, 4 Drawing Figures

METHOD OF UNIFORMLY APPLYING LIQUID TREATING MEDIA TO FORAMINOUS WORKPIECES

BACKGROUND OF THE INVENTION

The present invention relates to a method of uniformly applying liquid treating media to foraminous workpieces such as textile webs. The liquid treating media are to be foamed and applied to the workpiece in foamed condition.

A basic apparatus and method for this purpose have been disclosed in German Published Application DE-OS No. 2,523,062 which makes the advantages of applying the treating media in foamed state very clear. The known apparatus has a container above the workpiece, and the foam is deposited within this container, and is then squeezed through a wall of the container into the workpiece.

A problem with this approach is that the direct application of the foamed medium to the workpiece does not necessarily result in proper entry of the medium into the workpiece surface; depending upon the physical surface characteristics of the workpiece, surface differences from location to location, the chemical condition of the workpiece surface and the uniformity of any chemical application (or even the condition within the confines of the workpiece), the foam bubbles will burst at different rates of speed so that different quantities of released treating liquid are available for different surface areas. In other words: application of the foam to the workpiece and squeezing of the foam into the workpiece through a side edge of the application chamber does not assure uniform entry of the foam into the workpiece.

On the other hand, it is desired that foam carrying e.g. liquid ink particles or other substances transport liquid only in minimum quantities and that this liquid be completely yielded up to (absorbed by) the workpiece.

OBJECTS AND SUMMARY OF THE INVENTION

An object of the invention is to provide an improved method of treating a foraminous workpiece such as a textile web with foamed treating medium.

Another object is to ensure that the foam is deeply transported into the structure of the workpiece and that the surface of the workpiece is also provided with released (by the foam) liquid treating medium.

A concomitant object of the invention is to deposit the foam over a very small surface area of the workpiece at any one time.

In the method according to the invention the foamed treating medium is applied to the workpiece within a circumambiently restricted area such as four-sidedly delimited area, whereupon it is first drawn into the workpiece by suction and subsequently pressed in by squeezing. An advantage of this method is that the liquid carried by the sucked-in foam reaches deep into the workpiece (possibly as deep as the substrate) whereas the surface of the workpiece receives liquid foam bubbles which burst when squeezed into the surface. This eliminates the soaked "grey-veil" effect, which is especially important in the case of napped fabrics, for example carpeting or the like.

It is well known that napped textiles come in various degrees of hardness. According to the invention it has now been found that especially in the harder qualities of such textiles the surface structure of the workpiece acts in effect as a sieve or screen. This means that the workpiece surface structure destroys the foam bubbles, causing them to release their contained liquid; the application of this liquid is completely uniform over the entire area of application. The quantity of foam supplied per unit time is adjustable, and the vacuum used to draw it into the workpiece is also variable. This means that the quantity of liquid entering the workpiece per unit time can be maintained within a desired tolerance range of 1 to 5% in relationship to the liquid which it is desired to apply per surface area. This very exact result cannot be achieved with the prior art, since the angle of the side edge of the prior-art box is not variable; even if a doctor blade were used at this point, this could not change the quantity of liquid entering the workpiece.

An apparatus for carrying out the invention comprises means defining above the workpiece a space or container which is closed at four sides, one side of which is an applicator device such as a squeegee. Below the plane of passage of the workpiece there is arranged a suction device; as considered in the direction of workpiece movement, the applicator device is arranged downstream of the suction device.

A supply device may be provided which feeds the foamed treating medium into the container, one wall of which is wholly or in part constituted by the applicator device. The suction device may be a suction box with a suction slot. The applicator device downstream of the suction device may be a roller squeegee which may or may not be separately driven. The suction of the suction device is variable and the suction device may be located immediately upstream of the roller squeegee. Both the applicator device and the suction device preferably extend all the way across the working width of the apparatus.

When the foam is applied to the workpiece it is destroyed (the bubbles burst) and a minimum but adequate amount of released treating liquid is then available uniformly over the entire surface area of the workpiece, since such uniformity is assured by the applied suction which also determines the amount of liquid that is allowed to remain at the surface of the workpiece (instead of being drawn in).

A further advantage of using relatively low-grade adjustable suction resides in the fact that air is withdrawn from the interstices of the foraminous workpiece, thus allowing the liquid released by bursting of the foam bubbles to enter the workpiece much more easily. Also, mechanical resistance at the workpiece surface is thereby eliminated.

On the other hand, the additional mechanical squeegeeing of the foam, preferably but not necessarily by a roller squeegee, at a location downstream of the suction application, has the advantage that any not already burst bubbles are now definitely burst and made to release their liquid; further, it removes residual foam and liquid from the workpiece surface.

The invention is particularly suited for continuous operation. However, discontinuous operation is certainly possible. It would then only be necessary to make the suction device (and preferably the squeegee) movable backwards and forwards in direction of workpiece movement.

The invention will hereafter be described with reference to exemplary embodiments. These, however, are merely for the purpose of explanation.

DESCRIPTION OF PREFERRED EMBODIMENTS

Common to the apparatus of all embodiments is that they serve for the uniform application of liquid but foamed treating media to any kind of textile workpieces, especially webs. The invention is especially useful in napped workpieces, such as carpeting or the like, but is not limited thereto. The method will be explained in conjunction with the operation of the apparatus.

Figure 1:
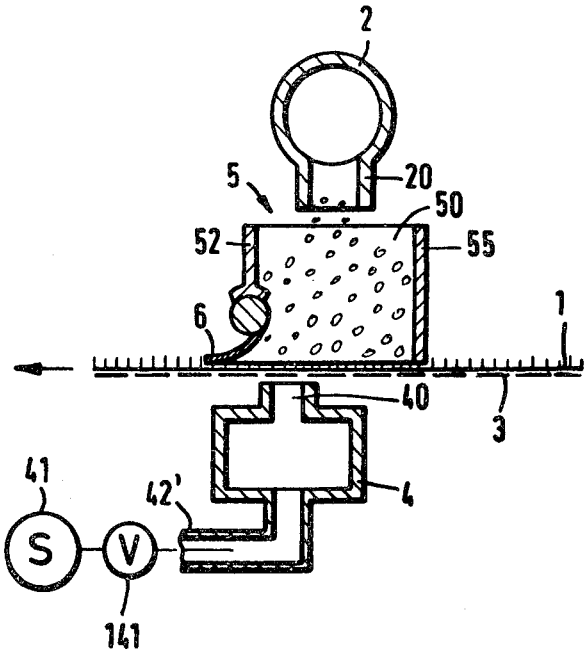
FIG. 1 is a diagrammatic side elevational view of one embodiment of an apparatus for the practice of the novel method.

In FIG. 1, reference numeral 2 identifies the foam supply device which may be a hose, pipe or duct provided with outlets 20 which are uniformly spaced over the width of the workpiece. The foam generator will be described with reference to FIG. 4.

Figure 2:
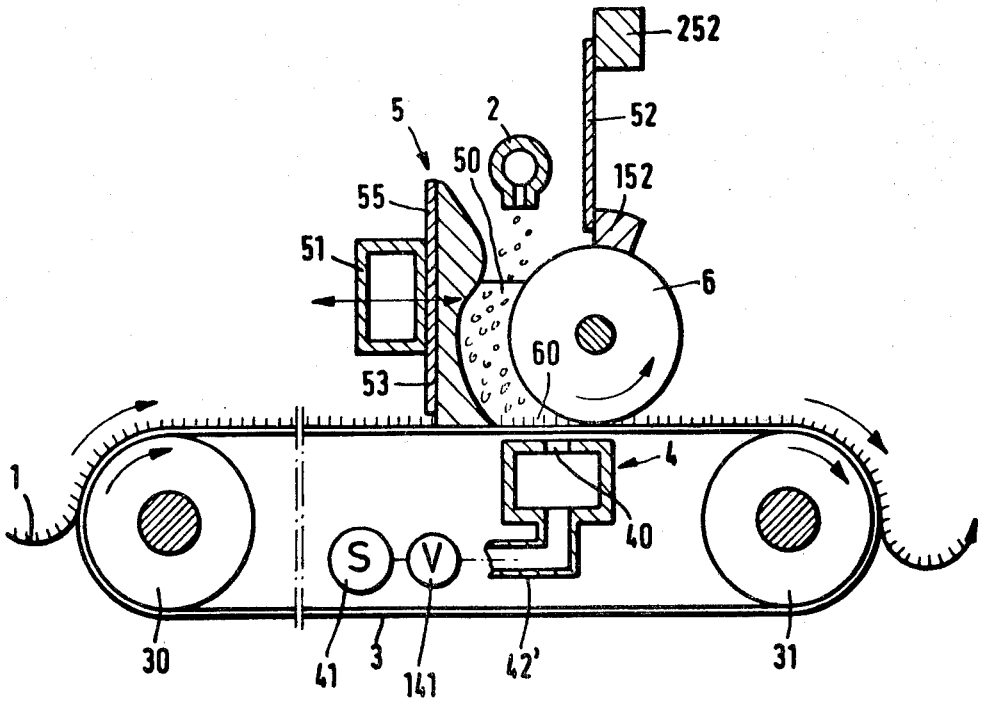
FIG. 2 is a similar view, but of a different apparatus for discontinuous operation.
Figure 3:
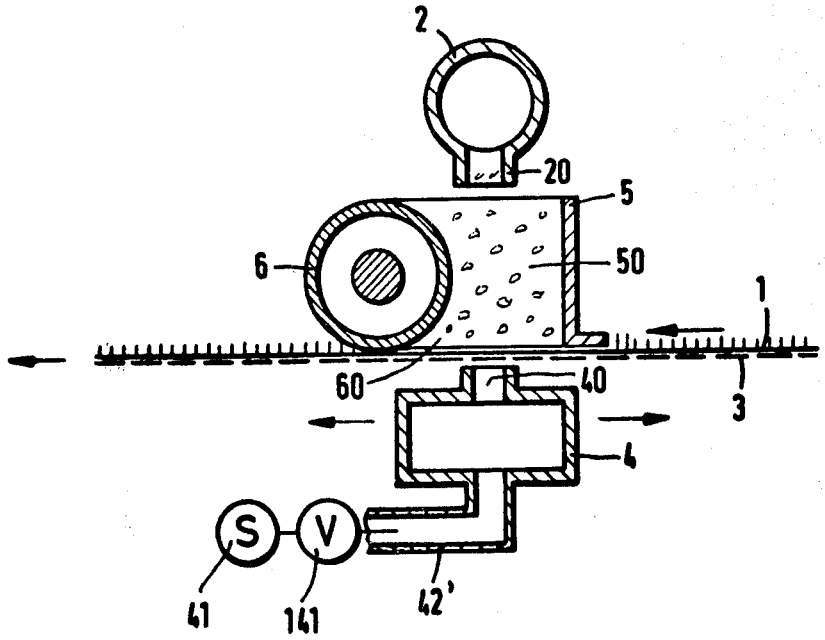
FIG. 3 is a view analogous to that of FIG. 1, but illustrating a further apparatus.

The workpiece 1 can—and, in view of the application of suction, as a rule will—rest on an air-permeable printing blanket 3. This may be endless, as shown in FIG. 2. However, instead of a printing blanket the workpiece may pass over a known-per-se screen drum in which the suction device 4 is then arranged. In the embodiments of FIGS. 1, 2 and 3 (in all embodiments like reference numerals identify like elements) the suction device is a suction box which extends over the entire working width of the apparatus and is provided with a suction slot 40. If a screen drum is used (not shown) the suction device will be of segmental shape.

FIG. 1 shows that atop the textile workpiece 1 there is arranged a space—e.g. the interior of a container 5—bounded on four sides but open to the workpiece. The foamed medium is deposited in this space by the device 2. In place of a container 5, sidewalls 50 could be used which could be adjustable relative to one another, and a front wall 55 be provided at the side at which the workpiece is incoming (as considered in the direction of workpiece movement).

Arranged below the container 5 or its substitute is the suction device 4 with its suction slot 40. Device 4 is connected with vacuum pump 41. The suction regulation is effected via a valve 141 or the like. Pump 41 can be connected with the suction device 4 via a hose (FIG. 4) or a stationary pipe 42'. What type of known-per-se vacuum pump or producer is used, is immaterial. Suction device 4 should be adjustable in its position (in the movement direction of the workpiece), but should preferably be fixed once it is set to a selected spot.

The rear wall 52 (as considered in the direction of workpiece movement) is partly formed by the applicator device 6. In FIG. 1 this is a doctor blade whose angle in relation to the movement of the workpiece is adjustable. The workpiece 1 on the printing blanket thus passes under the container 5 and over the suction device 4, whereupon it travels under the mechanical doctor blade so that the foam, after being sucked into the workpiece, is also pressed into the surface layer of the same. The wall 52 above device 6 prevents overflowing of the foam.

FIG. 2 shows a somewhat similar apparatus with an applicator device 6 which this time is constructed as a roller squeegee. The front wall 55 is supported on a traverse member 51 which can be secured in the machine frame at opposite sides of the apparatus; it is adjustable in the indicated arrow directions and can be arrested at any desired distance from the applicator device 6. Wall 55 may be specially profiled to form a channel 53 through which the foam can most expeditiously flow downwards.

Rear wall 52 is supported via a sealing strip 152 on the surface of the roller squeegee 6; the seal is adjustable to keep it tight. This wall, also, is supported on a traverse member which can be secured to the left and right of the workpiece in the machine frame. Suction device 4 is similar to the one in FIG. 1.

The embodiment of FIG. 3 has another roller squeegee as the applicator device 6; but it has a stationary container 5 and therebelow a suction device 4.

The Figures all show that the printing blanket 3 can be guided over rollers 30, 31. Evidently, it is both air and liquid-permeable. The rollers for it can be driven continuously or discontinuously; the former is generally preferred.

The low-grade vacuum, whose strength can be controlled, removes air from the workpiece so that a uniform, resistance-free entry of the liquid into the workpiece is obtained.

All embodiments show a napped workpiece, because the invention is particularly advantageous for such material. The suction device may also be an area-spanning box.

Due to the adjustability of the portion of the suction device 4 relative to applicator device 6 (e.g. roller squeegee) the effect of the suction device can be further selected. If it is desired to first remove air from the workpiece, the suction slot is located further away from device 6. If an effect is to be obtained on the already mechanically pressurized foam, the suction slot 40 is located close to the applicator device 6 (e.g. roller squeegee) under the wedge 60 defined by the applicator device 6 and the web 1 (see FIGS. 2 and 3).

Figure 4:
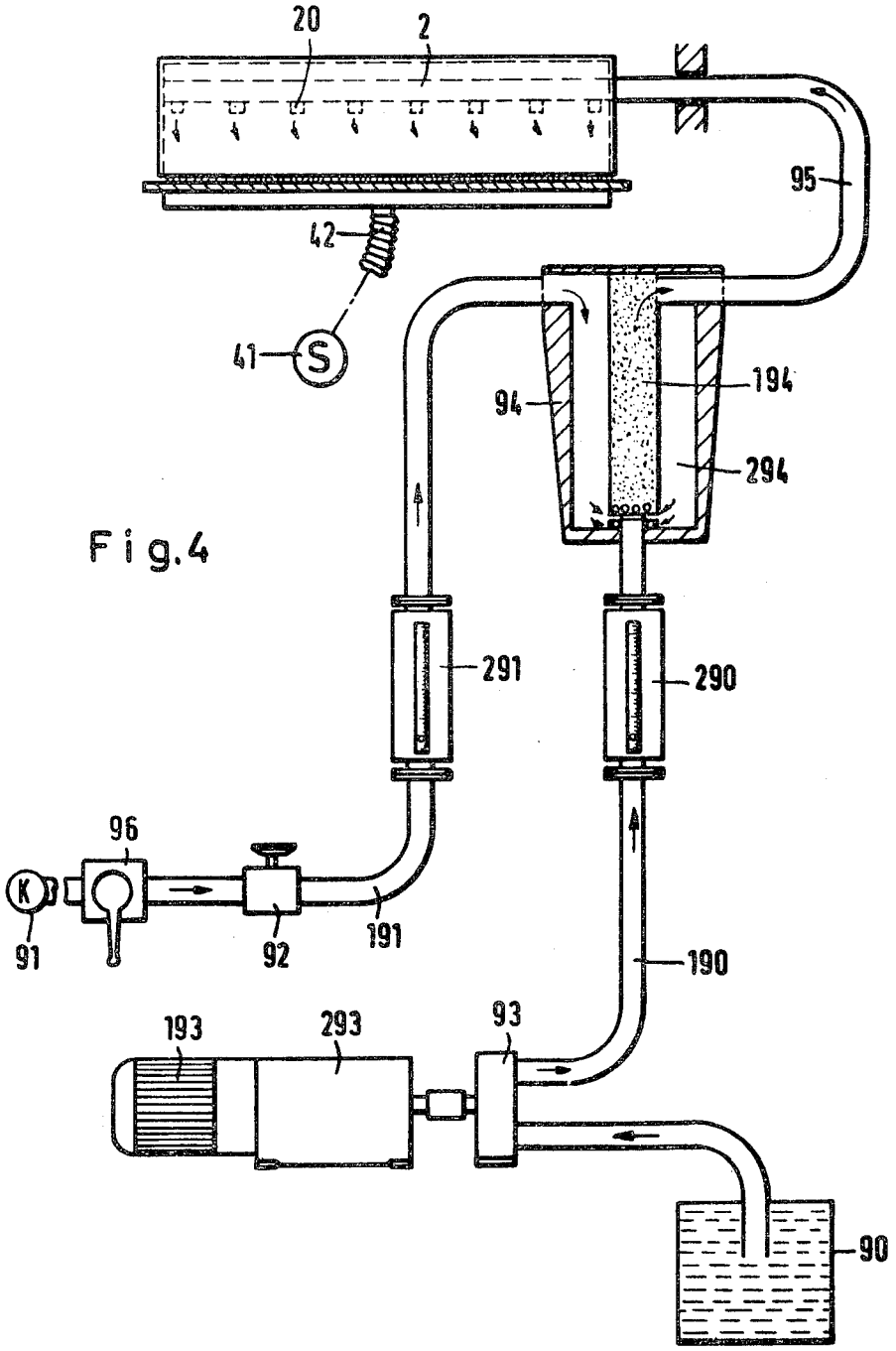
FIG. 4 is a diagrammatic side elevational view, illustrating an apparatus for the practice of the method and a foam generator therefor.

FIG. 4, finally, shows one embodiment of a foam generator for the apparatus in FIGS. 1-4. The liquid treating agent (of any kind that can be foamed) is contained in a reservoir 90. Compressed air is supplied from a compressor 91 or analogous device. The two are connected with a mixing head 94 via conduits 190, 191 in which quantity-measuring devices (known-per-se) 290 and 291 are installed. Control valves are also provided; only the valve 92 for conduit 191 is shown.

Liquid is pumped from reservoir 90 via a pump 93 which is driven by a motor 193 via a transmission 293. Thus, both liquid and compressed air enter the mixing head 94 which has a mixing chamber 194 containing glass beads, granulate or the like to aid in the foam formation. The compressed air is admitted into an annular space 294 surrounding chamber 194 and enters the same from below via appropriate openings. The thus created foam is then passed via a conduit, pipe, hose or the like 95 in a precisely set mixing ratio to the device 2, and from there onto the workpiece. A main shut-off valve 96 is interposed in air line 191.

The stream of foam flowing toward the point of application should be continuous and the rate of feeding the foam should match the consumption.

The squeegee device and the suction device can be built as a compact unit. The device 4 can be built so that the suction device and the squeegee device work upon the opposite sides of the same portion of the substrate.

I claim:

1. A method of uniformly applying a liquid treating medium to a foraminous workpiece, such as a textile web, having an upper surface and a lower surface, comprising the steps of foaming the liquid treating medium; depositing the foamed medium directly on the upper surface of the workpiece within a circumambiently restricted area which is open at the top for admission of foamed medium thereinto and extends downwardly all the way to the upper surface of the workpiece; applying suction to the lower surface of the workpiece to draw some of the foamed medium and liquid released by bursting of the foam bubbles into the workpiece at a single location below the restricted area; and thereafter mechanically pressing additional foamed medium from within the restricted area into the upper surface of the workpiece.

2. A method as defined in claim 1, wherein the step of mechanically pressing is effected with a doctor blade.

3. A method as defined in claim 1, wherein the step of mechanically pressing is effected with a roller squeegee.

4. A method as defined in claim 1; and further comprising the step of varying the degree of applied suction.

5. A method as defined in claim 1, wherein the step of mechanically pressing is carried out at a predetermined location and wherein the step of applying suction comprises applying suction at any one of several different locations relative to said predetermined location.

6. The method of claim 1, further comprising the step of transporting the workpiece in a predetermined direction along a predetermined path, said suction applying step being carried out upstream of said pressing step, as considered in said direction.

7. The method of claim 1, wherein said pressing step is carried out at the boundary of said restricted area.

8. A method of uniformly applying a liquid treating medium to a foraminous textile web, comprising the steps of foaming the medium; depositing the thus foamed medium directly on one side of the web within a circumambiently restricted area; applying suction to the other side of the web opposite the restricted area to cause at least some of the foam bubbles to burst and to draw the thus obtained liquid as well as non-liquefied foamed medium at least partially into the material of the web; and thereafter mechanically pressing at least some additional foamed medium from the one side into the material of the web.

9. The method of claim 8, further comprising the step of advancing the web in a predetermined direction along a predetermined path, said suction applying step being carried out upstream of said pressing step, as considered in said direction.

10. The method of claim 9, wherein said pressing step is carried out at the boundary of the restricted area.

* * * * *